US008020493B2

(12) United States Patent
Blum

(10) Patent No.: US 8,020,493 B2
(45) Date of Patent: Sep. 20, 2011

(54) TRACK-SWITCHING DEVICE AND METHOD

(75) Inventor: Steven C. Blum, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 331 days.

(21) Appl. No.: 12/344,624

(22) Filed: Dec. 29, 2008

(65) Prior Publication Data

US 2010/0163688 A1 Jul. 1, 2010

(51) Int. Cl.
*E01B 25/00* (2006.01)

(52) U.S. Cl. ..... 104/130.05; 104/101; 246/220; 246/415 R

(58) Field of Classification Search ..... 104/101, 104/130.05; 246/431, 257, 262, 263, 264, 246/293, 399, 401, 402, 415 R
See application file for complete search history.

(56) References Cited

U.S. PATENT DOCUMENTS

| | | | | |
|---|---|---|---|---|
| 3,033,126 | A * | 5/1962 | Graybeal | 104/101 |
| 3,635,166 | A * | 1/1972 | Peterson | 104/130.04 |
| 3,760,739 | A * | 9/1973 | Benner | 104/130.09 |
| 4,109,584 | A * | 8/1978 | Mihirogi | 104/130.06 |
| 4,468,986 | A * | 9/1984 | Foret | 74/822 |
| 5,247,890 | A * | 9/1993 | Mihirogi | 104/130.11 |
| 5,499,583 | A * | 3/1996 | Blumel | 104/130.03 |
| 5,547,151 | A * | 8/1996 | Giras et al. | 246/227 |
| 5,657,696 | A * | 8/1997 | Bishop | 104/130.05 |
| 5,806,809 | A * | 9/1998 | Danner | 246/220 |
| 6,296,208 | B1 | 10/2001 | Franke | |
| 6,691,958 | B2 * | 2/2004 | Biagiotti | 246/415 R |
| 7,699,272 | B2 * | 4/2010 | Arnold | 246/220 |
| 7,753,318 | B2 * | 7/2010 | Wagner et al. | 246/220 |
| 2001/0054670 | A1 * | 12/2001 | Franke | 246/220 |
| 2004/0129100 | A1 * | 7/2004 | Zimmermann et al. | 74/335 |
| 2005/0178929 | A1 * | 8/2005 | Biagiotti | 246/449 |
| 2006/0102804 | A1 * | 5/2006 | Biagiotti et al. | 246/415 R |
| 2008/0251649 | A1 * | 10/2008 | Salmans | 246/415 R |
| 2009/0045298 | A1 * | 2/2009 | Biagiotti | 246/452 |
| 2009/0065653 | A1 * | 3/2009 | Vance et al. | 246/415 R |
| 2009/0072097 | A1 * | 3/2009 | Arnold | 246/220 |
| 2009/0095846 | A1 * | 4/2009 | Roop | 246/415 R |
| 2010/0147183 | A1 * | 6/2010 | Weissbrodt | 104/307 |
| 2010/0163688 | A1 * | 7/2010 | Blum | 246/219 |

OTHER PUBLICATIONS

Lyman, Taylor, et al. Metals Handbook, 8th Edition, vol. 5, Forging and Casting, Part A: Forging: prepared under direction of the ASM Handbook Committee, p. 6; American Society for Metals; Metals Park, Ohio.

* cited by examiner

*Primary Examiner* — S. Joseph Morano
*Assistant Examiner* — Jason C Smith
(74) *Attorney, Agent, or Firm* — Fletcher Yoder

(57) ABSTRACT

The present disclosure provides an apparatus for switching a vehicle from a first track to a second track. The track-switching device may be rotated by a motor, and may have a drive axle and a primary axle. The drive axle may have a barrel located at one end of the drive axle, the barrel having a plurality of switch tracks located thereon and a braking assembly connected to the drive axle and spaced from the barrel. The primary axle may have a flywheel and a clutch assembly. The drive axle may then be driven by the primary axle upon engagement of the clutch assembly via the motor and the energy stored in the flywheel. A method for switching a vehicle from a first track to a second track is also provided.

15 Claims, 4 Drawing Sheets

TRACK-SWITCHING DEVICE AND METHOD

BACKGROUND

The present invention relates to tracks for vehicles. More particularly, the present invention relates to a track-switching apparatus and a method for switching tracks.

Since the early twentieth century, controlling the movement of vehicles that reside on tracks such as trains, intrafactory cargo vehicles, and amusement park rides has lead to important industrial growth and consumer satisfaction. In the case of amusement parks, as guests have demanded bigger, better, and more elaborate rides, they also require and expect a positive park experience, which entails progressively shorter and more rapidly moving lines to enter a ride.

One technique to shorten wait times for lines involves increasing the throughput of vehicles on a track. The more vehicles that pass a given point on a track in a given time interval, the more guests are capable of being served. However, in rides that have multiple tracks and require vehicles to switch tracks, there exists a lag or delay for the track-switch to take place. Decreasing the delay for track-switching increases vehicle throughput, thereby shortening guest wait time, and as a consequence, increases guest satisfaction and park profits.

In the past, conventional track-switching has been accomplished through the use of a pair of linked tapering rails, known as points, disposed between diverging outer rails. The points can be moved laterally from one position to another to direct a vehicle to a diverging track from a through track through the use of gear boxes, slide bars or motors. For example, U.S. Pat. No. 5,547,151 employs a linear induction rail switch mechanism having at least one linear induction motor for transversely thrusting a switch track from a first position to a second position.

More current track-switching mechanisms include spring assemblies such as that of U.S. Pat. No. 6,290,189, which describes a point-operating device for pressing a tongue against a stock rail while simultaneously pulling off another tongue from an opposite stock rail. The device is formed with at least four adjustable vertical spring assemblies, and is meant to prevent tongue hang-up.

However, known track-switching devices such as those mentioned above typically require a response time that may not meet the desired response time in some applications, such as amusement park settings, and are restricted to rail applications where the principal wheel assembly rides on a single side of the track, and lateral guidance is provided by a flange on the wheel.

In modern theme park attractions, such as roller-coasters, it is often necessary to have lateral guide wheels and vertical guide wheels on both the upper surface (i.e., load wheels) and lower surface (i.e., upstop wheels) of the track so that the ride vehicle is fully constrained to the track in all directions (save the desired direction of travel). These features substantially limit the utility of the aforementioned one-sided track switch assemblies Conventional track switches for theme park attraction applications generally comprise configurations that move laterally, rotationally about a vertical axis, and rotationally about a longitudinal axis, and involve separate locking and driving mechanisms. The driving mechanisms may be linked to the track switch assembly via conventional power transmission features, such as belts, drive shafts, chains, and gear trains. As such, the inertia of the drive mechanism and the switch assembly is always coupled to the mechanical system, providing practical limits to the combined acceleration and positioning accuracy of said switch types. Switching mechanisms similar to those discussed above may be found in, for example, U.S. Pat. No. 4,543,886 to Intamin Inc. and U.S. Pat. No. 6,884,177 to Vekoma S.p.A.

Manufactures have increasingly employed more powerful primary drive devices for switches that yield diminishing returns, as the self-inertia of larger and larger (e.g., electric) motors presents a first-order effect that defines the torque/horsepower/speed rise-time curve, particularly when the physical size and packaging of such devices is considered, this last resulting in necessarily causing such devices to be remote from the switched device, further increasing inertia and attendant switch timing delay.

Accordingly, to date, no suitable apparatus or method for rapid track-switching is available.

BRIEF DESCRIPTION

The present disclosure describes a track switching apparatus and a method for switching tracks.

In a first embodiment, the invention provides an apparatus for switching a vehicle from a first track to a second track. The track-switching device may be rotated by a motor, and may comprise a drive axle and a primary axle. The drive axle may comprise a barrel located at one end of the drive axle, the barrel having a plurality of switch tracks located thereon and a braking assembly connected to the drive axle and spaced from the barrel. The primary axle may comprise a flywheel and a clutch assembly. The drive axle may then be driven by the primary axle upon engagement of the clutch assembly via the motor and the flywheel.

In a second embodiment, the invention provides a method to switch a vehicle from a first track to a second track, the track-switching device being rotated by a motor, the method comprising providing a drive axle, providing a primary axle, driving the drive axle with the primary axle upon engagement of a clutch assembly via the motor and the energy stored in a flywheel and rotating the barrel about an axis to align switch tracks with the first tracks and second tracks. In this particular embodiment, the drive axle comprises a barrel located at one end of the drive axle, the barrel having a plurality of switch tracks located thereon and a braking assembly connected to the drive axle and spaced from the barrel. The primary axle comprises a flywheel and a clutch assembly.

Other features and advantages of the disclosure will become apparent by reference to the following description taken in connection with the accompanying drawings.

BRIEF DESCRIPTION OF THE DRAWINGS

Other features and advantages of the disclosure will become apparent by ref Reference is now made briefly to the accompanying drawings, in which.

Like reference characters designate identical or corresponding components and units throughout the several views, which are not to scale unless otherwise indicated.

DETAILED DESCRIPTION

Figure 1:
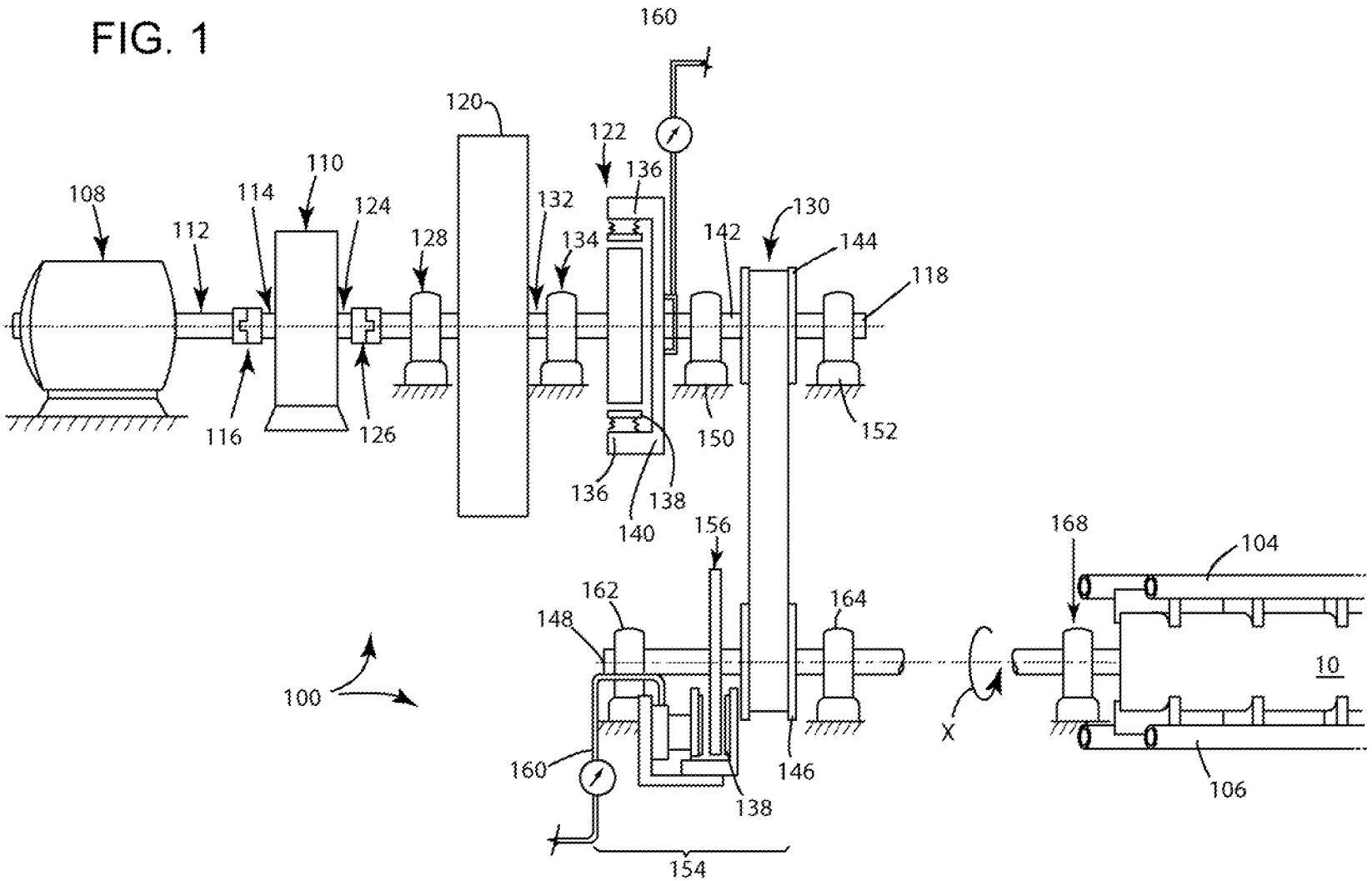
FIG. 1 is a schematic side-view diagram of a single track-switching device having an axially rotating barrel with switch tracks located there on in accordance with one embodiment of the invention.

One embodiment of the present invention involves a track-switching device for switching a vehicle from a first track to a second track the track-switching device comprising a drive axle and a primary axel mechanically coupled by a looped belt. The drive axle comprises a barrel located at one end of the drive axle, the barrel having a plurality of switch tracks located thereon, and a braking assembly connected to the drive axle and spaced from the barrel. The primary axle is driven by a motor and comprises a flywheel and a clutch assembly, wherein the drive axle is driven by the primary axle via a looped belt, the drive axle being configured to rotate about an axis. One particular advantage afforded by this invention is the ability increase track-switching speed (i.e., less than 2 seconds) thereby increasing vehicle throughput.

Specific configurations and arrangements of the claimed invention discussed below with reference to the accompanying drawings are for illustrative purposes only. Other configurations and arrangements that are within the purview of a skilled artisan can be made, used, or sold without departing from the spirit and scope of the appended claims.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Although specific features of various embodiments of the invention may be shown in some drawings and not in others, this is for convenience only. In accordance with the principles of the invention, the feature(s) of one drawing may be combined with any or all of the features in any of the other drawings. Moreover, any embodiments disclosed herein are not to be interpreted as the only possible embodiments. Rather, modifications and other embodiments are intended to be included within the scope of the appended claims.

As used herein, the term "first track" refers to a through track that a vehicle is located on before reaching the track-switching device, and may also refer to the track that the vehicle would continue upon if not switched by the track-switching device. As used herein, the term "second track" refers to a diverging track the vehicle is switched to after track-switch or the track that extends in a different direction than the through track. As used herein, the term "switch track" refers to the tracks that are located on the barrel and "switch track assembly" includes the tracks and a barrel or similar support or framework therefore. As used herein, the term "track" refers to dual rail tracks such as standard train track, single rail tracks that guide a vehicle on a fixed path, any guided path such as an optical guide means or otherwise and/or any combination of the foregoing. The term "barrel" may refer to a cylindrical object but is also intended to refer to any geometric shaped support for a track.

Referring now to FIG. 1, an exemplary track-switching device corresponding to embodiment of the present invention is shown generally at 100. The track-switching device is configured for rapid rotational acceleration, and provided to quickly and accurately switch a vehicle from a first track to a second track. The track-switching device may comprise a barrel 102 having a plurality of switch tracks 104 and 106 located thereon. In the exemplary embodiment shown in FIG. 1, a first straight switch track 104 is located on a side of barrel 102, while a second curved switch track is located on an opposite side of barrel 102. However, it is to be appreciated that multiple diverse switch tracks may be disposed around the circumference of the barrel, and can be commanded to any position on its rotational axis. The barrel 102 may be configured to rotate about an axis (X), causing at least one of the switch tracks 104 and 106 to be aligned with a diverging track (not shown).

With further reference to FIG. 1, shown is a primary axle 118 which comprises a flywheel 120, a transmission 110, clutch assembly 122, a pulley 130 for a flexible belt 132, and a series of input and output shafts configured to produce rotation about an axis. The motor 108 is mechanically coupled to a transmission 110 by motor output shaft 112. Connecting the motor output shaft 112 to the transmission input shaft 114 is universal joint 116. The motor 108 may be a traditional torque motor capable of producing a rotational force output. The transmission 110 is provided, as is known in the art, for a speed-torque conversion increasing the torque from the motor to provide a greater rotational force to the primary axel 118, and thus a faster and more robust axial rotation. The transmission 110 is mechanically coupled to a flywheel 120 via a transmission output shaft 124. Connecting the transmission output shaft 124 to the flywheel input shaft is a second universal joint 126. Furthermore, a first bearing 128 may be integrally connected to the transmission output shaft 124 to facilitate constrained relative rotational motion between two components (e.g., between the transmission 110 and the flywheel 120).

The flywheel 120 is configured to provide flywheel energy storage (FES) to the primary shaft. To store sufficient energy, the flywheel 120 preferably has an inertia that ranges from about 100 percent to about 1500 percent relative to the mass of the barrel 102 and switch tracks 104 and 106. More preferably it may range between approximately 400 percent and 800 percent. It will be understood that various combinations of flywheel mass and flywheel speeds may be employed to attain such an inertial value. When in operation, the motor accelerates the flywheel 120 to a high speed and the flywheel functions to retain rotational energy (i.e., momentum) which can be employed in the rotation of the primary axle 118 and, in turn, drive axle 148 and barrel 102 at rapid speed. The flywheel 120 is mechanically coupled to a clutch assembly 122 via a flywheel output shaft 132. A second bearing 134 may be integrally connected to the flywheel output shaft 132 to, again, facilitate constrained relative rotational motion between the flywheel 120 and the clutch 122.

The clutch assembly 122 may comprise forks 136, shoe 138 and shell 140. The clutch assembly 122 is configured to connect the flywheel output shaft 132 to the clutch output shaft 142 so that they can either be locked together and rotate at the same speed (engaged), or be decoupled and rotate at different speeds (disengaged). In this exemplary embodiment, when the clutch is engaged, rotational force may be transferred to the clutch output shaft 142.

The clutch output shaft 142 is connected to a pulley 144, the pulley 144 having a looped belt 130 mechanically coupled thereto. The looped belt 130 is further mechanically coupled to a second pulley 146, which is connected to the drive shaft 148. The looped belt 130 is configured to efficiently transmit power from from the primary shaft 118 to the drive axle 148. Third and forth bearings 150 and 152 may be integrally connected to the clutch output shaft 142, again, to facilitate constrained relative rotational motion between the pulley 144 and the clutch assembly 122. The looped belt 130 may be toothed, notched or cogged and may further be a flat or chain belt.

Referring still to FIG. 1, the drive axle 148 comprises a barrel 102 located at one end of the drive axle 148, and a braking assembly 154 connected to the drive axle 148 and spaced from the barrel 102. The braking assembly 154, as shown, a disc braking system in which a disc 156 is bonded to the drive axle 148. Calipers 158 are forced (e.g, hydraulically, pneumatically, electromagnetically, spring engaged) against both sides of the disc 156. Friction causes the disc and thus the drive axle to stop, in this case hydraulically via brake fluid supplied by line 160. Although a disc brake mechanism is shown, it is to be appreciated that other braking systems may be applicable in the present invention. It is to be further appreciated that fifth, sixth, seventh and eighth bearings (162, 164, 166 and 168) may be integrally connected to the drive axle 148 to, again, facilitate constrained relative rotational motion of the drive axle.

In operation, the motor 108 drives the transmission 110, which drives and powers the flywheel 120. The flywheel 120, in turn, drives and powers the primary axle 118 to rotate the looped belt 130, which, in turn, rotates the drive shaft 148 to switch the tracks of a vehicle traveling over the barrel. The brake assembly 154 holds the barrel in place, and a latch (not shown) may be actuated by the motion of the track switch to engage to lock the drive axle in a predetermined position. In further operation, when a switch function command is input, the braking assembly 154 engages and the clutch assembly 122 simultaneously disengages. When a second switch function command is input, the clutch assembly 122 is engaged and the braking assembly 154 is disengaged. In this embodiment of the present invention, the energy stored in the flywheel 120 is immediately and directly available to rotate the barrel 102 and facilitate a track switch.

In an exemplary embodiment of the present invention, the clutch assembly 122 is pneumatically, electrically, hydraulically or spring engaged (or disengaged) to connect the motor output shaft 112 to the flywheel 120 and in turn, to the barrel 102. The brake assembly 154 (e.g., pneumatic, hydraulic, electric, or spring actuated) resides on the drive axle 148. When the clutch 122 engages, the brake 154 disengages simultaneously. Both are timed to control the acceleration and deceleration of the track switch device 100, and to ensure that braking occurs with similar inertia and energy of the drive devices when disconnected from the drive axle 148. A positioning device (e.g., the latch) is employed as a secondary measure to ensure accurate predetermined position stopping. The latch may be actuated in and out of position to allow the switch to execute additional motions in the same rotational direction, or may be fixed, requiring gearing or other means to reverse the switch direction of travel for its return to starting position or other selected position in the opposite rotational direction.

Figure 2A:
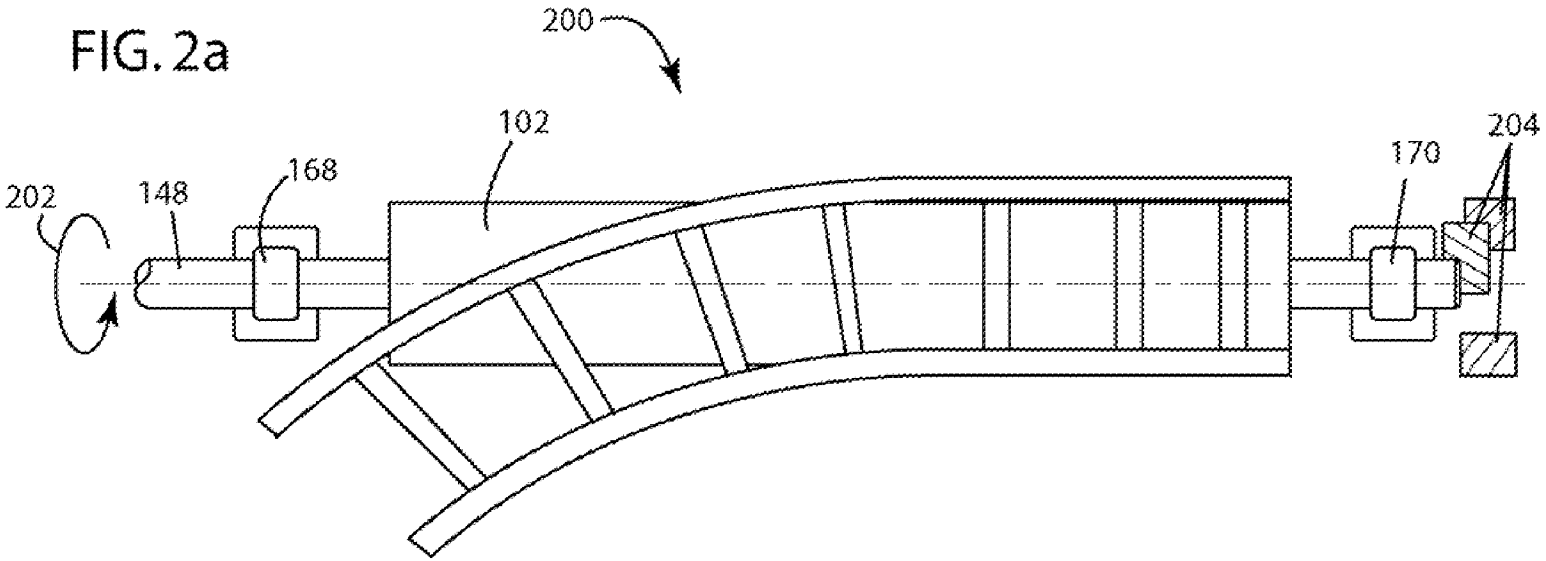
FIG. 2*a* is an overhead diagram of the barrel having switch tracks located thereon in accordance with an embodiment of the present invention.

Referring now to FIG. 2*a,* an overhead view of the barrel 102 having a switch track 104 located thereon is shown generally at 200. The drive axle 148 is configured to rotate about an axis as shown by arrow 202. Dampers 204 are configured to smooth out the shock impulse of the barrel rotation and immediate braking.

Figure 2B:
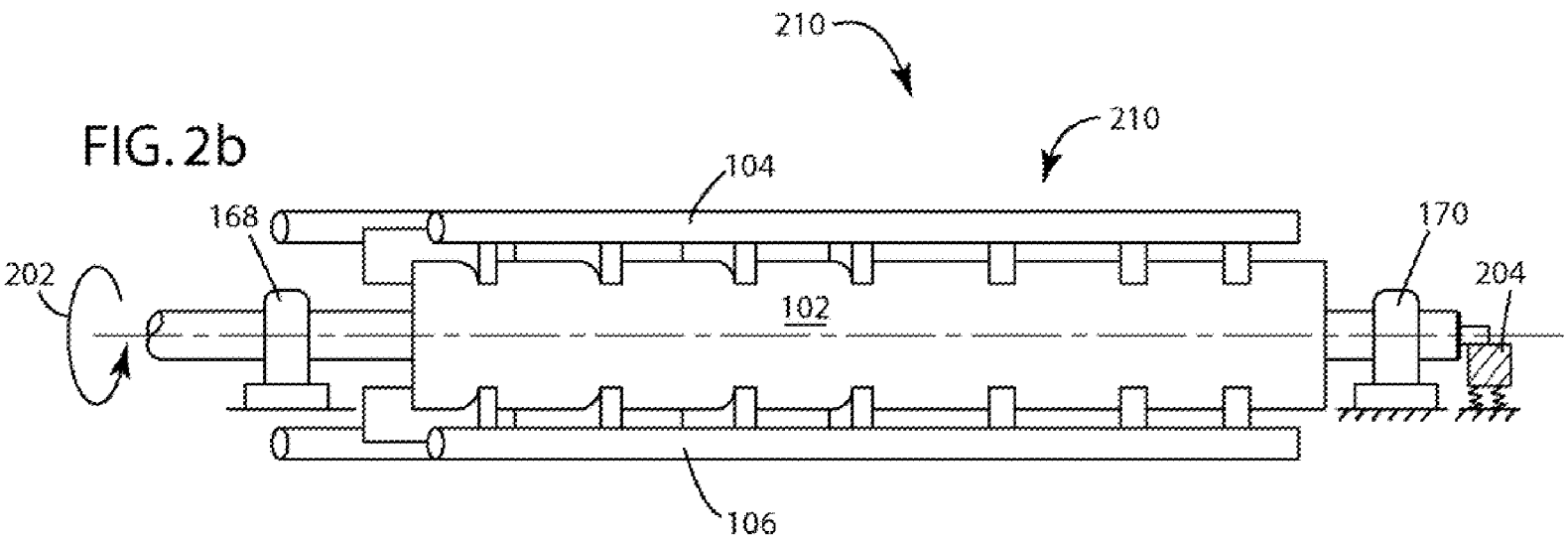
FIG. 2*b* is a side-view perspective of FIG. 2*a*.

Referring now to FIG. 2*b,* a side view of the barrel 102 is shown generally at 210. In this perspective, it can be more easily seen that two switch tracks 104 and 106 may be located on opposing sides of the barrel 102. One switch track may be configured as straight rails to maintain the vehicles motion from the path it originated, while the other switch track may be configured as curved to send the vehicle to a diverging track (shown in greater detail with reference to FIG. 3). Again, arrow 202 shows the applicable rotation.

Figure 3:
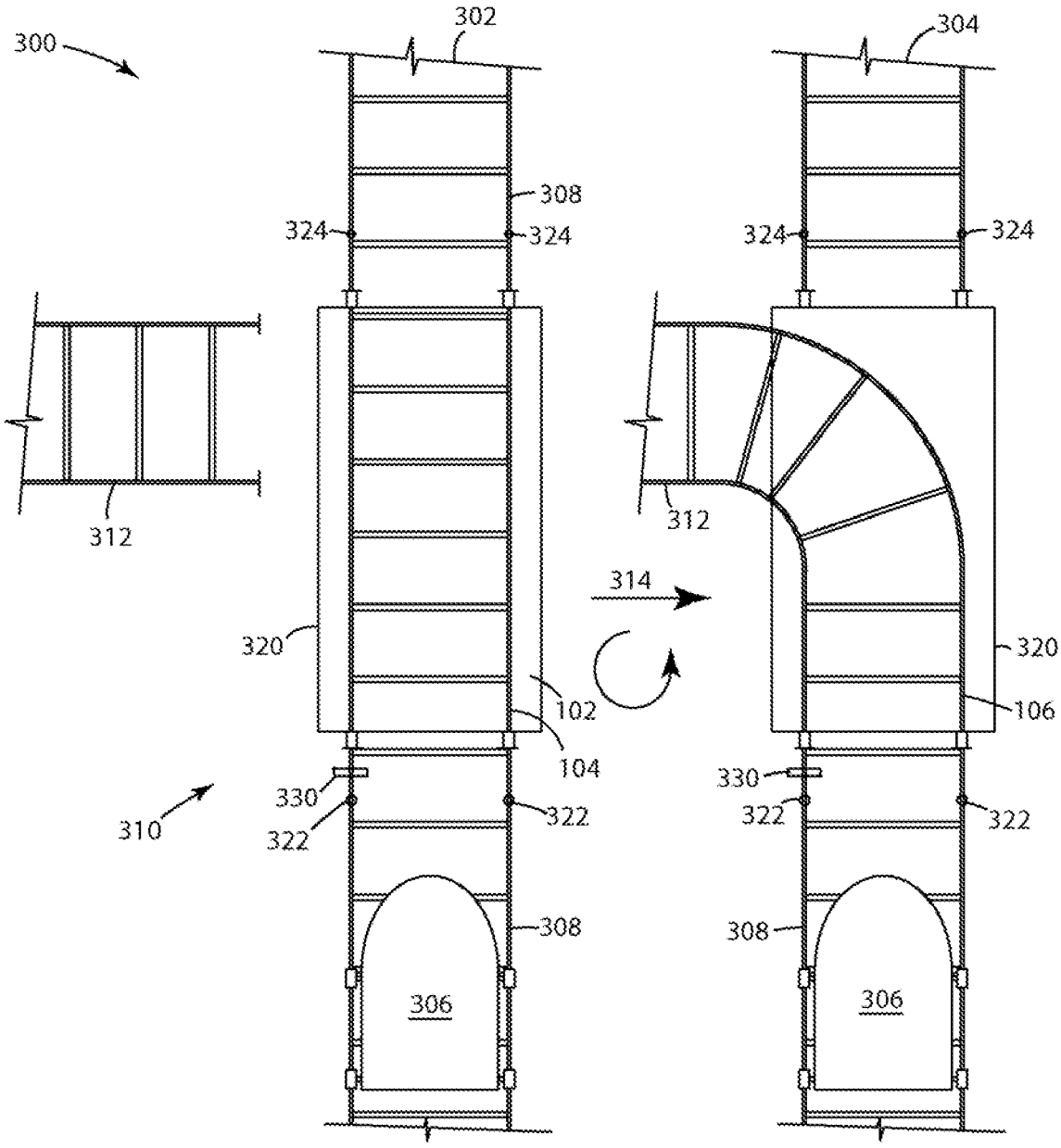
FIG. 3 is an overhead diagram of a track-switching system showing two track switching mechanisms for switching vehicles from a first track to a second track in accordance with one embodiment of the invention.

With reference now to FIG. 3, an overhead diagram of a track-switching system showing two locations in time (i.e., two different arrangements) is shown generally at 300. Reference number 302 shows pre-track switch configuration, while reference number 304 shows a post-track switch configuration. A first vehicle 306 is disposed on a first track 308. If it is desirable that the vehicle 306 remains on the first track, the barrel 102 may remain at rest at a first predetermined position 310. The vehicle 306 may then pass over switch track 104 and continue to first track 308 to a desired destination. However, if it desirable that the vehicle be routed to the left-hand diverging track 312, the barrel 102 may rotate clockwise a predetermined amount (e.g., 180 degrees) to a second predetermined position 304. In turn, the switch track 106 is aligned with left-hand diverging track 312, as shown by arrow 314. It is to be appreciated that while only one vehicle on a single through track and single diverging track is shown, the invention may comprise switching a plurality of vehicles to right-hand and left-hand diverging tracks, and also multiple through tracks. Therefore, barrel 102 may be configured to rotate in a bidirectional manner, i.e., clockwise and counter-clockwise to align a plurality of switch tracks with diverging or through tracks.

In the exemplary system shown in FIG. 3, a controller is in communication with a series of sensors (322, 324) to determine if an approaching vehicle is too close to allow safe track switch actuation when a track switch is requested by an overall ride control system. If no vehicle is present in a predetermined zone, then a track switch may be commanded. A blocking device 330 may be present between the sensors and the track switch device, and barrel position sensors are present on the switch assembly itself. If the switch fails to arrive at its final position or fails to latch within a specified time interval, the blocking device will remain closed (closed is its normal state). Similarly, another sensor 324 may be located downstream of the track switch to signal the track switch device is clear to rotate again. For example, the sensors may sense the vehicles location and signal the track-switching device 320 to rotate to align the switch track 104 or 106 with the through track 308 at a first end of the switch track or with diverging track 312 at a second end of the switch track, where the track may lock into place, via the braking mechanism. The vehicle 306 may then pass through onto the diverging track 312, where sensors 324 may sense the vehicle has exited that track-switching device 320, and send a command that the track-switching device may unlock and therefore rotate to switch vehicle 306 to the desired track.

It is to be appreciated that track sensors may be in communication with the track-switching devices, and also a central controller or processor, each component having the requisite electronics to carry out the above mentioned operations.

Figure 4:
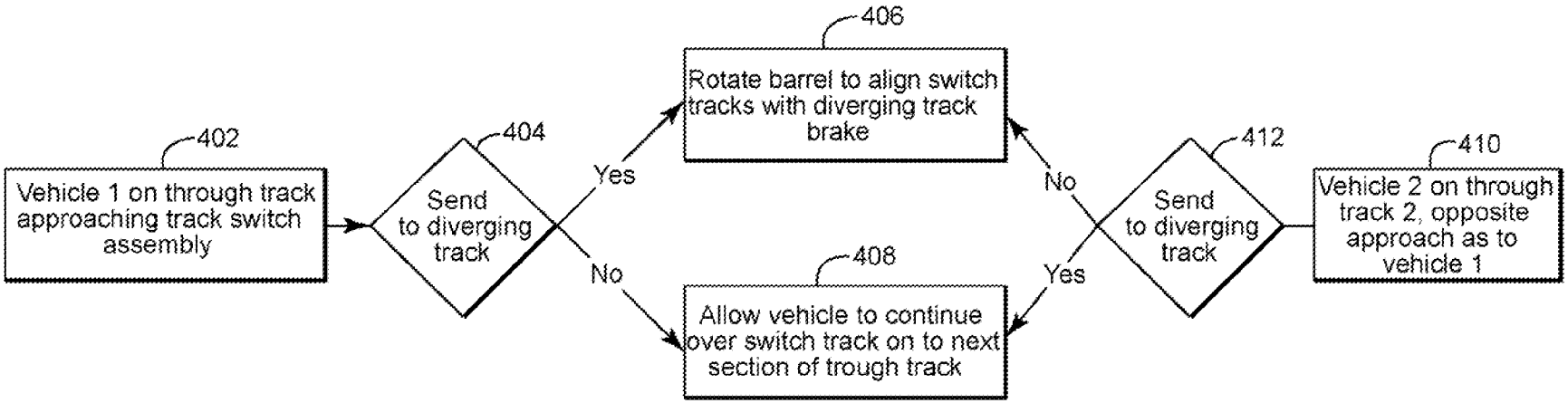
FIG. 4 is a flow-chart describing a step-wise method in accordance win a further embodiment of the present invention.

The exemplary system of FIG. 3 provides a secure and rapid switching mechanism for track vehicles. In particular, the system provides a secure and rapid switching mechanism for two or more vehicles It is to be further appreciated that while although in the exemplary embodiment of FIG. 4 only two track-switching devices having a single switch track are shown, a plurality of track-switches may be incorporated so sustain multiple vehicles from multiple different ingress and egress points.

In an optional embodiment of the present invention, the clutch output shaft 142, or a driven element of a secondary transmission (not shown) that may be driven by the clutch output shaft 142 may provide input energy and motive force to an escapement mechanism (not shown), such that the output motion from the clutch may be uncontrolled while the output motion of the escapement mechanism is bounded and deterministic.

In another optional embodiment, the track switch assembly can be separated into multiple pieces, thereby reducing the inertia of each actuated piece, and allowing for the vehicle entering the switch to proceed onto progressively switching elements along its path of travel, further reducing the temporal delay associated with track switch operation. In one such exemplary embodiment, the track switch mechanism may be comprised of three separate elements switched about axes approximately aligned with the vehicle longitudinal axes along its path of travel Referring now to FIG. 4, a flow-chart to better help illustrate a method for switching a vehicle from a through track to a diverging track is shown generally at reference numeral 500. The method comprises switching a vehicle from a first track (through track) to a second track (diverging track) the track-switching device being rotated by a motor, the method comprising providing a drive axle and a primary axle. The drive axle comprises a barrel located at one end of the drive axle, the barrel having a plurality of switch tracks located thereon and a braking assembly connected to the drive axle and spaced from the barrel. The primary axle is driven by the motor and comprises a flywheel and a clutch assembly.

The method further comprises driving the drive axle via a looped belt functionally connected to the drive axle and the primary axel and rotating the barrel about an axis to align the switch tracks with the first tracks and second tracks. While the flowchart shows an exemplary step-by-step method, it is to be appreciated that a skilled artisan may rearrange or reorder the steps while maintaining like results.

At step 402, a first vehicle on a through track may approach a track-switching device comprising a barrel having a plurality of switch tracks located thereon, the barrel being configured to align at least one of the plurality of switch tracks with the diverging track. As the vehicle approaches a plurality of sensors may sense the vehicles location on the trough track and, based on predetermined commands from a controller or processor, may either align at least one of the plurality of switch tracks with a diverging track or allow the vehicle to continue onto the next section of through tracks at step 404. If the controller is programmed to send the vehicle to the diverging tracks, then the controller may signal the track-switching device to horizontally rotate to align the switch tracks with the diverging tracks step 406. On the other hand, if the controller is programmed to allow the vehicle to continue to the next section of through tracks, then either the controller will align the switch tracks with the through tracks at step 408. At step 410, a second vehicle may approach from the opposite direction on a separate thorough track. At step 412, the controller makes an analogous decision as it does in step 404 to arrive at either steps 406 or 408 depending upon which track is the desirable track to send the vehicle. With each turntable rotation, the brakes may be configured to lock the tracks into place at a predetermined position.

Although specific features of various embodiments of the invention may be shown in some drawings and not in others, this is for convenience only. In accordance with the principles of the invention, the feature(s) of one drawing may be combined with any or all of the features in any of the other drawings. The words "including", "comprising", "having", and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

What is claimed is:

1. A track-switching device for switching a vehicle from a first track to a second track the track-switching device being rotated by a motor, the track switching device comprising:

a drive axle comprising:

a barrel located at one end of the drive axle, the barrel having a plurality of switch tracks located thereon; and a braking assembly connected to the drive axle and spaced from the barrel;

a primary axle driven by the motor, the primary axle comprising:

a flywheel; and a clutch assembly;

wherein the drive axle is driven by the primary axle upon engagement of the clutch assembly via the motor and the flywheel.

2. The track-switching device of claim 1, wherein the barrel is configured to rotate concurrently with the drive shaft to at least two predetermined positions and in a bidirectional manner.

3. The track-switching device of claim 1, wherein when the braking assembly is engaged the clutch assembly is simultaneously disengaged, and wherein when the clutch assembly is engaged the braking assembly is disengaged.

4. The track switching device of claim 1, further comprising a transmission attached to the primary shaft and driven by the motor, the transmission having an output shaft configured to drive the flywheel.

5. The track switching device of claim 1, wherein the flywheel comprises an output shaft configured to drive the clutch assembly.

6. The track switching device of claim 1, wherein the clutch assembly comprises an output shaft configured to drive the loop belt to rotate the drive shaft.

7. The track switching device of claim 1, wherein the flywheel has an inertia that ranges from between approximately 100% and approximately 1500% of that of the barrel and the switch tracks.

8. The track switching device of claim 1, further comprising a latch configured to engage lock the drive axle when the barrel is in a predetermined position.

9. The track-switching of claim 1, further comprising a controller in communication with a plurality of sensors.

10. A method for switching a vehicle from a first track to a second track the track-switching device being rotated by a motor, the track switching device comprising:

providing a drive axle comprising:

a barrel located at one end of the drive axle, the barrel having a plurality of switch tracks located thereon; and a braking assembly connected to the drive axle and spaced from the barrel;

providing a primary axle driven by the motor, the primary axle comprising:

a flywheel; and a clutch assembly; and driving the drive axle with the primary axle upon engagement of the clutch assembly via the motor and the flywheel; and rotating the barrel about an axis to align the switch tracks with the first tracks and second tracks.

11. The method of claim 10, wherein the barrel is configured to rotate concurrently with the drive shaft to at least two predetermined positions and in a bidirectional manner.

12. The method of claim 10, wherein when the braking assembly is engaged the clutch assembly is simultaneously disengaged, and wherein when the clutch assembly is engaged the braking assembly is disengaged.

13. The method of claim 10, wherein the flywheel has an inertia that ranges from between approximately 100% and approximately 1500% of that of the barrel and the switch tracks.

14. The method of claim 10, further comprising locking the barrel at a predetermined location by engaging a latch with the drive axle when the barrel is in the predetermined position.

15. The method of claim 10, further comprising a controller in communication with a plurality of sensors.

* * * * *